US008016640B2

(12) United States Patent
Morgan

(10) Patent No.: US 8,016,640 B2
(45) Date of Patent: Sep. 13, 2011

(54) CLOTHING

(76) Inventor: Joanne Lynsey Morgan, Nottingham (GB)

( * ) Notice: Subject to any disclaimer, the term of this patent is extended or adjusted under 35 U.S.C. 154(b) by 0 days.

(21) Appl. No.: 10/584,388

(22) PCT Filed: Dec. 21, 2004

(86) PCT No.: PCT/GB2004/005352

§ 371 (c)(1),
(2), (4) Date: Aug. 22, 2006

(87) PCT Pub. No.: WO2005/060773

PCT Pub. Date: Jul. 7, 2005

(65) Prior Publication Data

US 2007/0123143 A1 May 31, 2007

(30) Foreign Application Priority Data

Dec. 23, 2003 (GB) ..... 0329720.7
Sep. 22, 2004 (GB) ..... 0420999.5

(51) Int. Cl.
*A41C 3/00* (2006.01)

(52) U.S. Cl. ..... 450/62; 450/63; 450/64

(58) Field of Classification Search ..... 450/39, 450/59, 40, 44, 62–64
See application file for complete search history.

(56) References Cited

U.S. PATENT DOCUMENTS 1,026,326 A 5/1912 Leporin
1,584,525 A * 5/1926 Freeman ..... 450/62
1,590,693 A * 6/1926 McKeefrey ..... 450/61
1,890,507 A 1/1930 Gifford
1,984,253 A 12/1934 Cox
2,079,426 A 5/1937 Schottenfels
2,406,699 A * 8/1946 Lustig ..... 450/64
2,475,624 A * 7/1949 Laszlo ..... 450/63
2,523,715 A * 9/1950 Panes ..... 450/60
2,793,369 A 4/1954 Panighini
2,734,193 A * 2/1956 Croxall ..... 450/63
3,054,408 A * 9/1962 Cousins ..... 450/60
3,255,754 A 6/1966 Brumberger
3,419,895 A * 12/1968 Stephensen ..... 450/60
3,491,762 A * 1/1970 Simonsen ..... 450/60
3,642,009 A * 2/1972 Nobbs ..... 450/60
3,710,800 A * 1/1973 Carey ..... 450/64

(Continued)

FOREIGN PATENT DOCUMENTS

CH 338801 7/1959

(Continued)

OTHER PUBLICATIONS

European Office Action dated Mar. 26, 2009; 5 pages.

(Continued)

*Primary Examiner* — Gloria Hale
(74) *Attorney, Agent, or Firm* — Collard & Roe, P.C.

(57) ABSTRACT

The invention relates to a breast support apparatus for use with any garment. The sling or wrap of material is elasticated or "stretchable" and non-slip, for example, being of cotton/polyester. The sling or wrap of material has been shaped as shown with the ends being narrowed to the width of elasticated, connecting strap, the ends being joined to the strap and to one another, for example, by appropriate stitching. The ends of the strap are passed through an opening in metal connecting buckle of the connecting strap. The connecting strap may be used to connect or hook the breast apparatus to an appropriate location on an outer garment.

8 Claims, 9 Drawing Sheets

U.S. PATENT DOCUMENTS

| | | | | |
|---|---|---|---|---|
| 3,769,987 | A * | 11/1973 | Markowitz | 450/60 |
| 3,934,593 | A | 1/1976 | Mellinger | |
| 3,982,547 | A | 9/1976 | Walker | |
| 4,324,254 | A | 4/1982 | Freedman et al. | |
| 4,343,313 | A | 8/1982 | Le Jeune | |
| 4,372,320 | A | 2/1983 | Silber | |
| 4,655,224 | A | 4/1987 | Stern et al. | |
| 5,171,182 | A | 12/1992 | Heinen | |
| 6,113,460 | A | 9/2000 | McKeown | |
| 6,231,424 | B1 | 5/2001 | Valentin | |
| 6,755,717 | B2 * | 6/2004 | Smith | 450/1 |
| 7,452,260 | B2 * | 11/2008 | Redenius | 450/63 |
| 7,497,760 | B2 * | 3/2009 | Redenius | 450/60 |
| 7,549,908 | B2 * | 6/2009 | Yudkoff | 450/62 |
| 7,645,179 | B2 * | 1/2010 | Redenius | 450/60 |
| 7,677,951 | B2 * | 3/2010 | Redenius | 450/60 |
| 2003/0129923 | A1 | 7/2003 | Chong et al. | |
| 2003/0186617 | A1 | 10/2003 | Sorensen | |

FOREIGN PATENT DOCUMENTS

| | | | |
|---|---|---|---|
| DE | 10231636 | | 1/2004 |
| EP | 1386548 | | 2/2004 |
| GB | 403528 | | 12/1933 |
| GB | 435414 | | 9/1935 |
| GB | 464114 | | 4/1937 |
| GB | 595743 | | 12/1947 |
| GB | 809804 | | 3/1959 |
| GB | 2208785 | | 4/1989 |
| JP | 07 090703 | A | 4/1994 |
| JP | 07090703 | | 4/1995 |
| JP | 09 003 706 | | 1/1997 |
| JP | 2001/1254207 | | 9/2001 |
| JP | 2002 038308 | A | 2/2002 |
| JP | 2002-309404 | | 10/2002 |
| WO | WO 80/00121 | A | 2/1980 |
| WO | WO 94/10865 | A | 5/1994 |
| WO | WO007470 | | 2/2000 |
| WO | WO2004012539 | | 2/2004 |

OTHER PUBLICATIONS

International Search Report, Mailed on Feb. 3, 2006 for PCT/GB2004/005352 that was filed on Dec. 21, 2004.

European Search Report, Date of Completion of Search was Oct. 31, 2003 for EP 02 02 9083 that was filed on Dec. 30, 2002.

Communication pursuant to Rule 70(2) EPC and reference to Rule 39(1) EPC, dated Apr. 7, 2008 for Application No. 07006831.7.

Patents Act 1977—Search Report under Section 17 for Great Britain, Search dated Oct. 15, 2004 for Application No. GB0420999.5.

Patents Act 1977—Further Search Report under Section 17 for Great Britain, Search dated Dec. 3, 2004 for Application No. GB0420999.5.

International Search Report.

* cited by examiner

CLOTHING

CROSS REFERENCE TO RELATED APPLICATIONS

Applicant claims priority under 35 U.S.C. §119 of Great Britain Application No. 0329720.7 filed Dec. 23, 2003 and Great Britain Application No. 0420999.5 filed Sep. 22, 2004. Applicant also claims priority under 35 U.S.C. §365 of PCT/GB2004/005352 filed Dec. 21, 2004. The international application under PCT article 21(2) was published in English.

This invention relates to improvements in or relating to clothing and is more particularly concerned with improvements in or relating to female underwear or breast support structures, such as brassieres.

Ladies fashion garments often have thin shoulder or neck straps or may be strapless and/or backless or halterneck (and/or transparent/translucent and/or very delicate and/or may be nightwear/swimwear) and it is believed that known methods of breast support and/or enhancement with such garments under which a conventional brassiere cannot suitably be worn (herein after called 'garments of the type specified') tend to be disadvantageous or rather unsatisfactory, at least in some circumstances. The term 'thin strap' is meant to refer to a width of strap which cannot conveniently be employed to completely cover a brassiere strap.

Of course, if conventional brassieres (shoulder-strap or halter neck) were to be worn with such garments the straps of the brassieres would be visible or apparent and spoil the desired effect of the garment.

Many proposals have been made in an effort to provide suitable breast support or enhancement with garments of the type specified, ranging from brassieres with transparent plastics straps or straps which crisscross low down on the back, for example, around the waist, or strapless brassieres that comprise an underwire and cups that are attached to the breasts by double-sided, disposable dermal adhesive tape. It is believed that none of these arrangements are entirely satisfactory. For example, where transparent straps are provided on the brassiere, these can, nevertheless, still be seen on the body, for example around the shoulders or neck, or wherever the straps lie and are not really comfortable or reassuring for the wearer. Once again, brassieres that include crisscross straps that wrap around the waist are necessarily designed in such manner that they tend to squash the breasts rather than support and uplift them and tend to be disadvantageous in that the straps may create unsightly ridges of flesh detectable underneath the garment. The use of adhesive tape on the breasts to attach the brassiere is far from ideal and often does not work at all well for a substantial period of time, so that the brassiere will simply become detached from the wearer. Additionally, the double-sided tape tends to be relatively expensive and can only be used once. Also, the adhesive may adhere quite strongly to the body necessitating considerable pain or discomfort for the wearer to remove the adhesive completely. Furthermore, it is believed that a relatively natural look is very difficult to achieve with such brassieres that tend not to lift and support the breasts in the manner required. Rather, such brassieres tend to be confining and may pull the breasts downwardly or create unnatural bulging, depending upon the particular size, shape and uniformity of breasts. In summary, some brassieres for such garments, disadvantageously, may have a low back or clear strap back (or even a halter neck strap) or include breast cups that have to be attached by adhesive tape to the wearer and which extend around the side of the body. Other brassieres for such garments, disadvantageously, may not lie completely flat on the skin and may be seen or detected through the garment covering the brassiere more particularly where the garment is of delicate or thin fabric material, said garment, for example, being evening wear where such brassieres are usually required. With some strapless and backless brassieres requiring the use of adhesive tape, the downward force of gravity on the breasts has to be balanced using the friction of the brassiere against the skin of the breast and, since such brassieres have a relatively small surface area, flesh may be pinched and effectively squeezed out of the sides of the brassiere. Indeed, this problem seems to be more acute where the strapless and backless brassiere is a convertible brassiere (i.e. a brassiere having straps that can be removed from the brassiere if desired for use with certain garments) which needs to be worn more tightly when used without straps in a backless and strapless garment scenario. Even so, the problem may occur with low back, strapless or halter neck brassieres or where the brassiere straps are thin or transparent (as such straps tend to press or dig into the skin to a greater extent causing ridges of flesh on the body).

Once again, it is believed that known backless/strapless brassieres do little to compensate for the difference in size between the breasts that most women have so that the breasts may not lie level when supported by the brassiere. It tends to be disadvantageous that some backless/strapless brassieres may alter the appearance or outer shape of the garment when worn in a way not desired by the wearer. Such backless/strapless brassieres tend to be disadvantageous in that many different sizes are required for different sizes of breast and sometimes such set sizes tend not to fit very well more particularly where the wearer has a significant size difference (e.g. one cup size) between her breasts. Also, there would appear to be few such brassieres on the market for cup sizes over a 'C' cup. There are some such brassieres for cup sizes larger than a 'C' but they tend to be disadvantageous as they may drag the breasts downwardly to some extent requiring more or less constant re-adjustment by the wearer. This is why there tends to be more choice in brassieres of cup size under a 'C' cup i.e. because it would appear easier for brassieres of this type to support smaller breasts. Furthermore, some backless/strapless brassieres tend to be too firm or rigid and impart an unnatural rigidity or look to the breasts when viewed through, or from outside of, the covering garment. Brassieres for garments of the type specified may have other additional disadvantages not discussed further in this specification.

It is known to provide a breast support in the form of a sling or shelf for supporting both breasts simultaneously without covering the nipples, thus allowing a greater freedom. However, the sling or shelf includes adjustable shoulder straps which would be visible with garments of the type specified and thus would not be suitable for such garments.

German Patent Specification No. DE 10231636 shows a self-adhesive strip of film that may be wound off an applicator reel directly onto the body and around the breast. Such arrangements tend to be inconvenient and awkward to apply. The film strip is not re-usable since the 'tacky' quality is lost after one application and could not be wound back onto the applicator reel. Moreover, the thin film does not have a self-sustaining or memory shape and may possibly adhere to itself in an inconvenient manner.

U.S. Pat. No. 6,231,424 shows a brassiere having breast cups attached to the body by adhesive tabs positioned near the arms at the outside only of each breast. Thus, there is no sling or wrap of material (more particularly for an individual breast) suspended or supported from a location at or above an upper portion of the associated breast/s or at least above the nipple/s of the breasts. Thus, the arrangement tends to be disadvantageous in that little uplift or re-shaping is given to the breasts (more particularly in the cleavage region of the breasts). Indeed, there is a disclosure of use of an underwire/supporter and a rigid reinforcement member for enhancing the appearance of the breasts.

It is an object of the present invention to at least alleviate one or more of the aforementioned, or other, disadvantages associated with breast support and/or breast enhancement for garments of the type specified.

According to the present invention there is provided breast support apparatus for supporting at least one breast from underneath a covering garment of the type specified, said apparatus comprising at least one sling or wrap of material arranged in use to lift and support said breast, said sling or wrap being suspended, in use, from the garment, or on the body of the wearer from underneath the garment.

Usually, said breast support apparatus will be without shoulder and/or neck and/or back support straps.

Further according to the present invention there is provided a garment of the type specified having at least one breast support apparatus attached or attachable thereto in order to suspend the breast support apparatus, said breast support apparatus comprising a sling or wrap of material for supporting at least one breast in use.

Further according to the present invention there is provided breast support apparatus in the form of a sling or wrap of material for suspending at least one breast from a garment of the type specified in use, said apparatus including suspension means for the sling/wrap of material, said suspension means being attachable to a garment of the type specified to be worn with the breast support apparatus. The sling/wrap of material may be releasably fastenable to the suspension means.

Further according to the present invention there is provided a method of supporting at least one breast, said method comprising suspending said breast in a sling or wrap of material and supporting the sling or wrap of material on a garment of the type specified or on a body of the wearer from underneath a garment of the type specified and, preferably, from a location at or above an upper portion of the breast.

Usually, the breast support apparatus will be adapted to support an individual breast (so that two such breast support apparatuses will normally be required for one wearer) although in other embodiments both breasts may be supported simultaneously side by side by said breast support apparatus (particularly applicable for larger breasts).

By embodiments of the present invention the sling or wrap of material of the breast support apparatus can be arranged to lift and support the or each breast giving some shaping to same by suspending the breast against the force of gravity, preferably, from a location or locations at or above an upper portion of the breast/s or at least from above the nipple/s of the breast/s.

Further according to the present invention there is provided breast support apparatus for supporting at least one breast from underneath a covering garment of the type specified, said apparatus including means for lifting and supporting said breast, said means being suspended, in use, from a location or locations above the nipple of said breast, said location or locations being from the garment or on the body of the wearer from underneath the garment. Said means for lifting and supporting the breast may comprise a sling or wrap of material.

Preferably, the sling or wrap of material is flexible and may be elasticated or 'stretchable' and may grip the breasts preferably in a non-slip manner. Preferably, the sling or wrap of material does not have a preformed shape and may adapt at least in part to the shape and/or size of the or each breast.

Even so, it is possible in some embodiments of the invention that the sling or wrap of material is provided with padding material such as foam which may conveniently be in the form of a suitably shaped insert or inserts. Preferably, the insert or inserts is/are readily removable from the sling or wrap of material and replaceable with a different size/sizes to suit the wearer.

The sling or wrap of material may be releasably fastenable to the garment of the type specified to be worn with the breast support apparatus or may be permanently or semi-permanently attached thereto.

Where a releaseable fastening to the garment is provided as aforesaid, said fastening may be of any suitable means such as one or more press studs or surface contact fastening material such as Velcro (Velcro is a registered trade mark) or means such as a button and receiving hole, or hole that receives a loop, or tie of the sling or wrap material. The suspension means may comprise a strip of material on which is mounted part of the releasable fastening with the remainder of the releasable fastening being provided on the sling/wrap of material e.g cooperating female part of a press stud may be provided on said material strip where male press stud part is on the sling or wrap of material. Said strip of material may be connected to the garment by any convenient means such as by stitching and/or heat activated adhesive.

In some embodiments of the present invention, the fastening location or locations of the sling/wrap of material to the garment may be adjustable (more particularly in the height direction of garment). In this way where two breast support apparatuses are provided (one for each breast), if necessary, one breast may be supported from a higher point on the garment than the other in order to even up the position of the breasts where there is a lack of uniformity or considerable size difference between same.

Conveniently, the fastening location of the or each breast support apparatus may be provided on an upper inside edge of the garment (near an associated shoulder or neck support strap on the garment if provided).

Additionally, or alternatively, each breast may be provided with associated breast support apparatus comprising a sling or wrap of material of a different size or shape to the other in order to achieve a more uniform or balanced overall appearance.

It is possible that the or each breast may be supported by said sling or wrap of material which is suspended from a location or locations on the body rather than on the garment itself In such an instance, the sling or wrap of material may be, for example, supported by (possibly double-sided) dermal adhesive tape located at or above an upper portion of the breast. It is believed in such a scenario that the breast/s will be held more securely by the adhesive tape than when the breast is supported from underneath by e.g. a semi-rigid cup connected by double-sided adhesive tape to the underneath curved part of the breast. In practice, where double-sided adhesive tape is used to attach a strapless and backless brassiere to a curved part of the breast, the brassiere can become detached from the breast more easily than should be the case. However, it is envisaged that, where double-sided adhesive tape is used in conjunction with the sling or wrap of material in accordance with the present invention, the adhesive tape means be attached to an upper part of the breast/s which should not give rise to problems in detachment.

Usually, the ends of the sling or wrap of material will be close to one another when worn on the breast/s and may, for example, be connected closely adjacent to one another on the garment to be worn. It is possible that the ends of the sling or wrap of material may be connected together before the sling or wrap of material is connected to the garment so that there is only a single attachment location on the garment for the sling or wrap of material. However, it is also possible for the ends of the sling or wrap of material to be connected to the garment at spaced locations if required. Even so, usually, the ends of the sling or wrap of material will be close to one another on the garment (or a single attachment location is provided), since it is believed this will provide a better support and uplift than if the sling/wrap of material is connected to the garment at relatively widely spaced locations. On other occasions, a different feeling or effect may be desired by the wearer, which would suit the ends of the sling or wrap of material being connected to the garment at spaced locations.

It is believed that creating a sling or wrap of material for the breast/s which forms a closed hoop of "stretchable" material surrounding snugly and hugging and lifting the breast/s, which is suspended from a point at or above the upper portion of the breast/s, effectively lifts and cradles the breast/s providing a much more natural and enhanced appearance than current brassieres for garments of the type specified.

The sling or wrap of material may leave the nipple/s of the breast/s exposed prior to coverage with the garment to be worn with same and, thus, the breast support apparatus may also include separate or integral nipple cover means for modesty purposes.

Whilst one breast apparatus may be used to support both breasts simultaneously this may move the breasts more closely together than might be wished for with some shapes and sizes of breasts.

Thus, it is believed that the employment of two individual breast support apparatuses (one for each breast) may prove to be the most advantageous embodiment of the present invention at least for smaller breasts. It is believed that individual slings or wraps of material for each breast should give the maximum uplift and shaping to both sides of the breast and allow the most advantageous, natural, if damped, swing of the breasts relative to the garment.

Many other advantageous features of the present invention will be apparent from the following description and drawings.

An embodiment of breast support apparatus in accordance with the present invention, will now be described, by way of example only, with reference to the following somewhat diagrammatic drawings, not drawn to scale, in which:—

Figure 2:
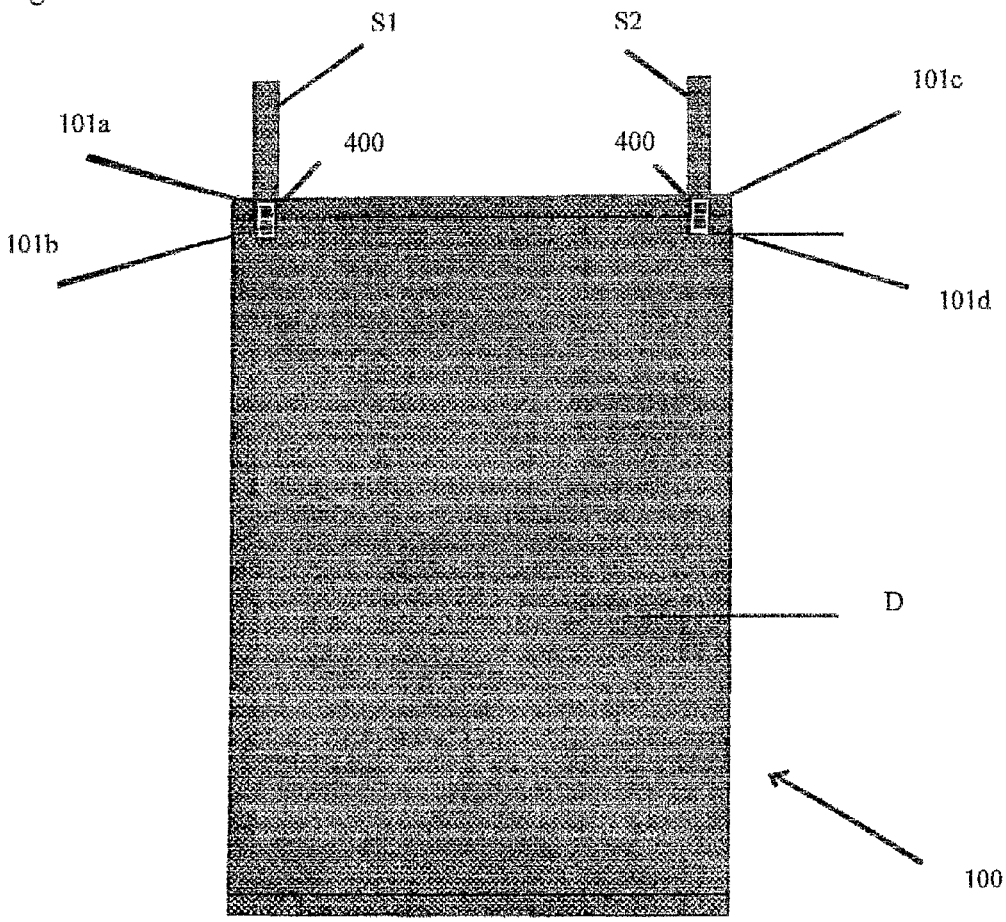
FIG. 2 shows an inside-out view of a garment of the type specified to be worn with two breast support apparatuses of FIG. 1.
Figure 5A:
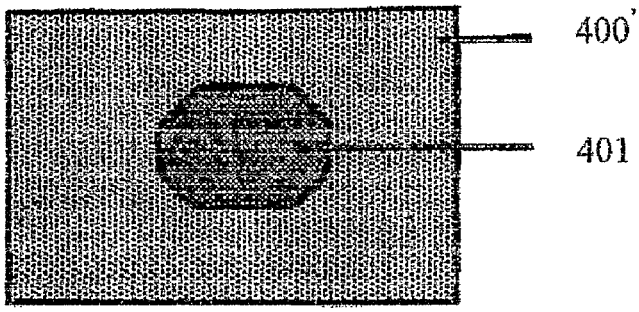
Figure 5B:
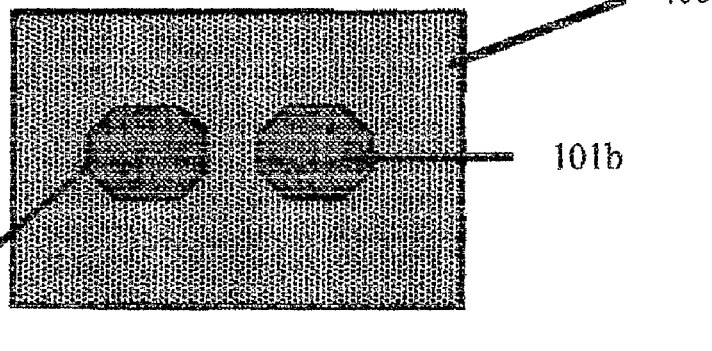
Figure 5C:
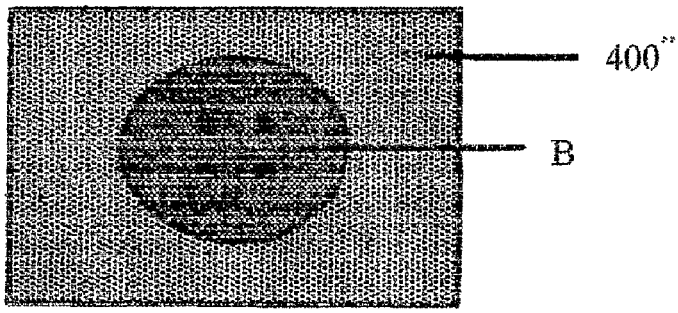
Figure 5D:
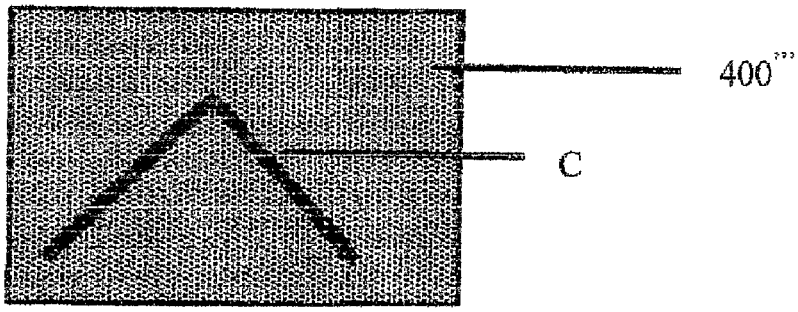
Figure 6A:
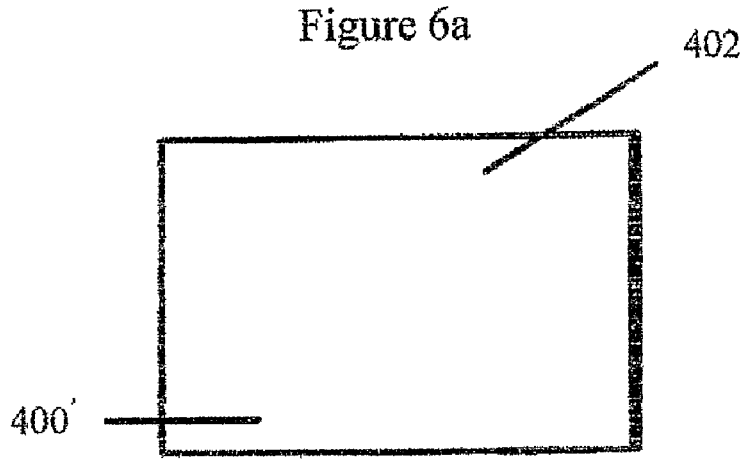
Figure 6B:
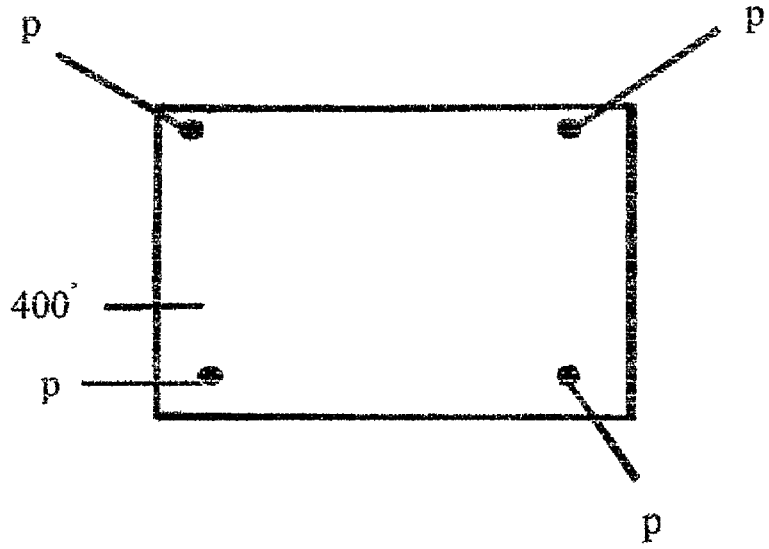

FIGS. 5*a*, 5*b*, 5*c*, 5*d* show four views of alternative suspension means for fastening the breast support apparatus that may be attachable to the garment in FIG. 2, and FIGS. 6*a*, 6*b* show two alternative underside views of the suspension means shown in FIGS. 5*a*-5*d*.

Figure 1:
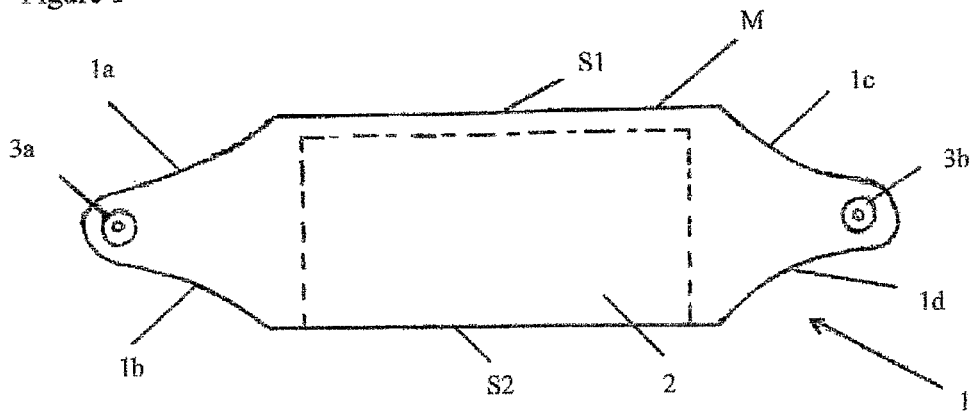
FIG. 1 shows a plan view of breast support apparatus for an individual breast.

Referring to FIG. 1 of the drawings, breast support apparatus 1 adapted for supporting an individual breast includes a suitably shaped length of material M.

The breast support apparatus 1 may include any suitable material M such as an elasticated or "stretchable" (preferably non-slip) fabric that could be of cotton/polyester or woven or knitted construction or which may, for example, be of lace. The material M may be single, double or multi-layered and may or may not comprise a suitably shaped pocket 2 (shown for convenience as rectangular dashed lines) for a suitably shaped insert of foam padding or the like that could be used to enhance or increase the apparent size of the breast.

In this particular embodiment, the length of the breast support apparatus 1 is 23 cm and the width is 8 cm, with the length of the upper and lower parallel straight sides S1, S2 being 14 cm each. Each end of the breast support apparatus 1 is shaped inwardly by oppositely curved side edges 1*a*, 1*b*; 1*c*, 1*d* towards male press stud portions 3*a*, 3*b* that seat in respective female press stud portions 101*a*, 101*b*; 101*c*, 101*d* mounted on suspension means in the form of a rectangular strips of material 400 on the inside of a flimsy garment 100 of the type specified having thin shoulder straps s1, s2 (see FIG. 2 and FIG. 5*b*). The male press stud portions 3*a*,3*b* each comprise one half of co-operative releasable fastening means 3*a*,3*b*;101*a*,101*b* for the ends of the breast support apparatus 1. The female press stud portions 101*a*,101*b* on the garment form the mating halves of the releasable fastening means for said breast support apparatus 1. The female press stud portions 101*a*, 101*b* are shown in enlarged detail in FIG. 5*b*. The shoulder straps s1, s2 are only shown in part for ease of illustration. The garment 100 is in the form of a top of semi-transparent material D through which bra straps of a conventional brassiere would be visible.

In use of the breast support apparatus 1 by a wearer (more particularly as shown by the girl 200 in FIG. 3) each individual breast 201 is initially encircled from underneath and supported in a manner with the apparatus 1 (means for lifting and supporting the breast 201) acting as a sling or wrap around the breast from underneath to lift and support same. The curved shaping of the apparatus 1 allows the formed sling to sit neatly on the breast 201. Advantageously, the breast 201 is gripped by the stretchable material of the sling to hold the breast in a non-slip manner. Once one breast 201 has been encircled by the associated breast support apparatus 1 and the ends of same brought close together, male press stud portions 3*a* and 3*b* can be releasably connected to female press stud portions 101*a*, 101*b* or 101*c*, 101*d* to suspend the apparatus 1 and hence the associated breast 201 from the garment 100. The other breast may be suspended from a second breast support apparatus 1 in a similar manner with male press-stud portions 3*a*, 3*b* being engaged into the vacant female press stud portions 101*a*, 101*b* or 101*c*, 101*d*.

Figure 3:
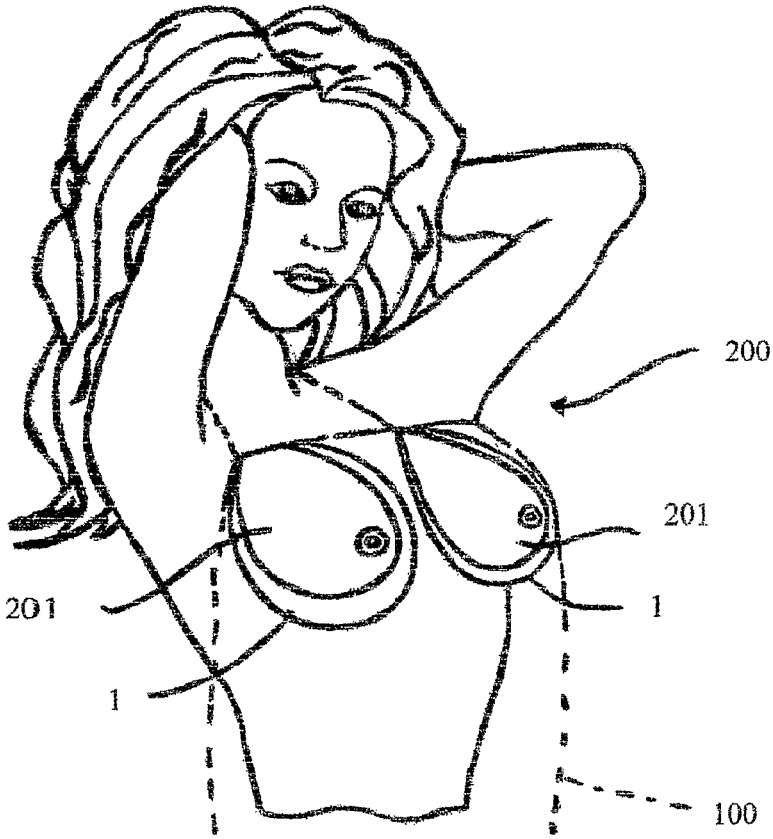
FIG. 3 shows a view of the upper half of a girl wearing an associated breast support apparatus as shown in FIG. 1 on each breast, said breast support apparatuses being connected to the garment as shown in FIG. 2.

It is to be noted that the garment 100 includes very thin straps s1, s2 that pass around the neck of the girl shown in FIG. 3 and which may, for example, be part of a halter neck of a garment. The garment 100 could not be worn with a conventional brassiere having straps since the straps could not be hidden from view by the thin straps S1,S2'.

Accordingly, two breast support apparatuses 1 may be worn with the garment 100 to lift and support the breasts in a discreet manner.

Since each breast 201 is supported individually by separate support apparatus 1, it is believed that a more natural look may be obtained, more particularly where the nipples are only covered by the garment 100 itself.

It is to be appreciated that the breast support apparatus has not been provided with inserts in FIG. 3 of the drawings.

Figure 4:
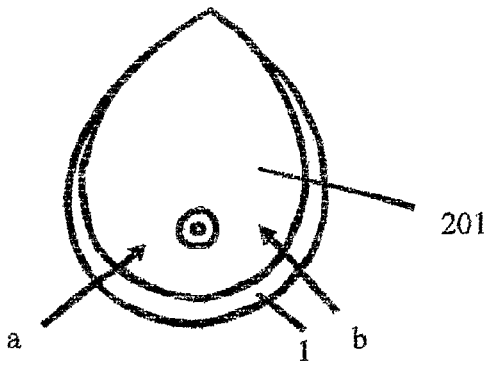
FIG. 4 shows a front view of one of the girl's breasts shown in FIG. 3 fitted with the breast support apparatus of FIG. 1.

FIG. 4 of the drawings shows a front view of an individual breast 201 supported by breast support apparatus 1 (FIG. 1). Since the breast 201 is supported by the support apparatus 1 which acts in the manner of a sling, it is believed that better lift and support is given to the breast, from underneath and from both sides, more particularly by forces acting in directions of arrows a and b in the FIGURE. Thus the breast 201 itself is not squashed or flattened out or lifted directly from underneath in a manner which could cause bulging. Importantly, the breast 201 is fully supported in an area extending outwardly from the junction of the breast with the body rather than merely from underneath at a location spaced from said junction. Thus, the breast support apparatus 1 hugs the contour of the breast 201.

In an alternative embodiment of the present invention (not shown), the connection or fastening location on the garment for the fastening means on the breast support apparatus 1 may be adjustable (preferably height adjustable) by any suitable means so that where there is a significant discrepancy between the size or shape of the breasts, one breast may be supported at a location on the garment which is higher than the other if one breast needs more lift and support than the other to provide a more uniform balanced appearance. The height adjustment may be continuously adjustable or provided by a number of preselectable positions.

Instead of providing such a height adjustable connection on the garment 100 itself, a different size of breast support apparatus 1 may be used for the second breast so that each may be supported from a similar height location on the garment with the second breast support apparatus 1 having different support parameters that will allow the second breast to be lifted higher relative to the first.

FIGS. 5*a*-5*d* show variant suspension means 400', 400, 400" and 400'" having different fastening or connection means of the brassiere support apparatus 1 to the garment 100. FIG. 5*a* shows a rectangular piece of material 400' including the female portion 401 of a press-stud fastening that may be co-operable with a single male press stud portion, not shown on the breast support apparatus 1, rather than two male press stud portions being provided, and FIG. 6*a* shows an underside view being provided with a self-adhesive backing 402 that may be heat activated, for example, by an iron, to attach same to garment 100. Such an arrangement may be used with the single press-stud arrangement shown in FIG. 5*a* or the double press-stud arrangement shown in FIG. 5*b*.

FIG. 5*c* shows an alternative fastening arrangement having a rectangular piece of material 400" with a button B that may be co-operable with one or more loops or button holes (not shown on the breast support apparatus 1) instead of press stud fastenings 3*a*,3*b*;101*a*,101*b*. Similarly FIG. 5*d* may be provided with a right-angled slot C for ties (not shown) on the breast support apparatus 1 to pass therethrough and be tied on the reverse side of strip 400'".

Additionally, or alternatively, the reverse side of the strip of material 400, 400', 400", 400'" may be provided with preplaced stitch holes p as shown in FIG. 6*b* for attachment or added securement to the garment 100.

The aforedescribed embodiment of the present invention provides for the breast apparatuses 1 to be releasably suspended from spaced locations on the garment 100. However, the connections of the breast support apparatuses 1 to the garment 100 may be effectively permanent or semi-permanent or alternatively the breast apparatuses could be suspended directly from the wearer's body (for example by double-sided adhesive tape, conveniently attached to an upper portion of the associated breast, or from above the breast, but underneath the garment 100).

Although not shown, in an alternative arrangement the breast support apparatus may comprise a sling or wrap of material that encircles both breasts rather than just an individual breast. Thus only one central upper suspension location for such breast support apparatus (either on the garment or the body of the wearer may be required).

It is possible that the breast support apparatus in accordance with the present invention is more cup-shaped or bag-shaped covering more of the breast 201 than as shown in FIGS. 3 and 4 of the drawings. It is also possible that the breast apparatus 1 could be stretched to cover more or less of the breast as desired to suit the wearer.

Advantages of embodiments of the present invention may be as follows:

1. A true backless breast support apparatus may be provided.
2. No lines, creases or wrinkles viewable through or from outside of the garment of the type specified.
3. No adhesion of the breast support apparatus to the underside of the breasts.
4. Much greater variety of sizes available for garments of the type specified due to greater uplift.
5. No encircling of the trunk of the body by the breast support apparatus.
6. Breast support apparatus may be an accessory to the garment or part of the garment.
7. Where two breast support apparatuses are required, said apparatuses can be sold in a variety of different forms and connected to the suspension means.
8. There may be an attachment point to the garment with respect to breast position.
9. Adjustability or support apparatuses to cater for differently sized breasts so they appear to be level underneath the garment.
10. A single, double or multiple point of attachment may be provided for by the breast support apparatus.
11. Pre-cut sewing holes may be provided and fasteners by a variety means some of which may be readily available on the market.
12. The breasts support apparatuses may be sewn on (attached) in a shop or as part of a tailored service.
13. An (adjustable) arrangement may be provided so that only one size of breast apparatus need be provided for differently sized breasts.
14. The breast support apparatus may be much less expensive to manufacture than brassieres for garments of the type specified.
15. The breast apparatus may be produced in a variety of fabrics, and there could be a variety of fabrics and materials involved to support the breast in different (enhanced) ways, more particularly depending upon the nature of the garment of the type specified being worn and the type of breast support desired by the wearer.
16. A breast cover/s may be provided to cover the nipples. It is to be noted that the breast cover/s may be designed to perform an additional support function to merely covering the nipple, more particularly where the breast is relatively soft and fluid. Relatively soft and more fluid breasts may occur more regularly in older females and such breasts may be more difficult to support adequately using a sling which allows a soft breast to locally deform causing 'flow' or 'hang' over the sling of part of the breast. The additional support function provided by the cover may be to alleviate such flow or hang over occurring. The nipple cover may cover substantially the entire breast.
17. The breast support apparatus does not have to be a preformed rigid cup that could yield an undesirable false appearance to the breast.
18. Garments of the type specified could include: swimsuits, bikinis, halterneck, strappy, delicate, low-back and backless garments or nightwear and the breast support apparatus could also be worn with any garment rather than just garments of the type specified thus obviating the need for different types of breast support apparatus with different garments.

19. The breast support apparatus may be more delicate and/or sensual than other apparatus provided for garments of the type specified.
20. The breast support apparatus may not be rigid although parts may be in some embodiments
21. May not alter the shape of the garment at all since the breast apparatus may work within or be determined by the contours of the breast itself and may be to all intents and purposes substantially undetectable whilst the garment is being worn.

It is to be appreciated that the present invention offers many improvements, at least some of which might be patentable individually or in combination. Any individual feature as aforementioned or as shown or implicit herein or combinations thereof, or functions or methods appertaining thereto, may be patentably inventive and any specific term as used herein should not be construed as unnecessarily or unduly limiting; the scope of such a term should extend to, or may be replaced or supplemented by, any equivalent or generic expression. For example the term 'sling' could be replaced by 'strap' or 'strip' or 'flexible support' or 'suspension apparatus or 'means for supporting a breast'; 'breast support apparatus' may be replaced by 'breast re-shaping or breast mass redistribution apparatus'. Additionally, any range mentioned herein for any parameter or variable shall be taken to include a disclosure of any derivable sub-range within that range or of any particular value of the variable or parameter arranged within, or at an end of, the range or sub-range. The singular may include the plural and vice versa.

Therefore, still further according to the present invention there is provided breast support apparatus for supporting at least one breast from underneath a covering garment, said apparatus comprising an adjustable sling or adjustable means for encircling or partially encircling and supporting said breast, the size of said sling or means encircling/partially encircling the breast being (automatically) adjustable to cater for different sizes of breast and or size difference between two breasts of a wearer.

The Applicant has made further improvements or modifications to the breast support apparatus.

Figure 7:
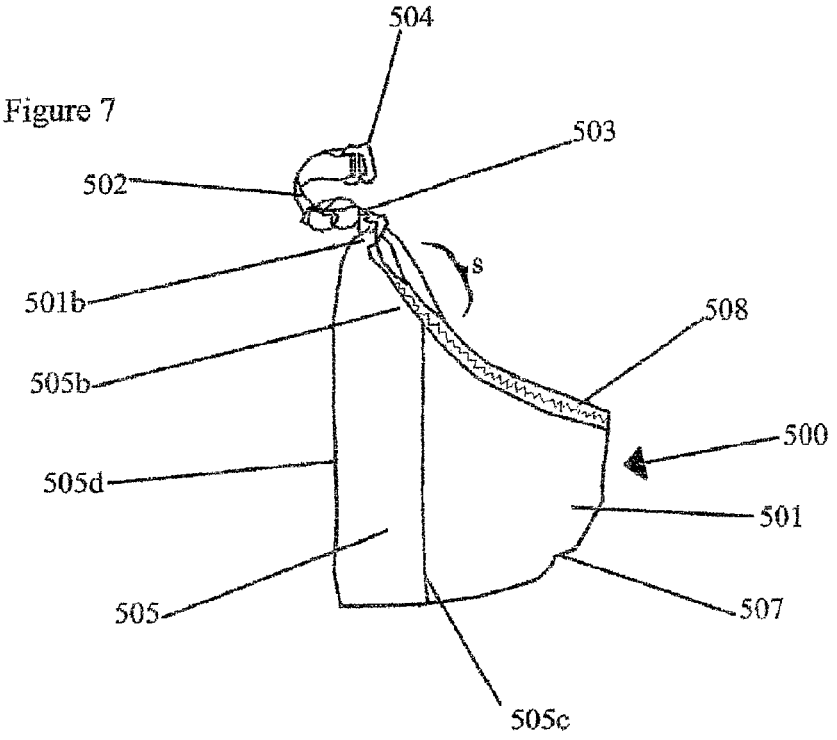
Figure 8:
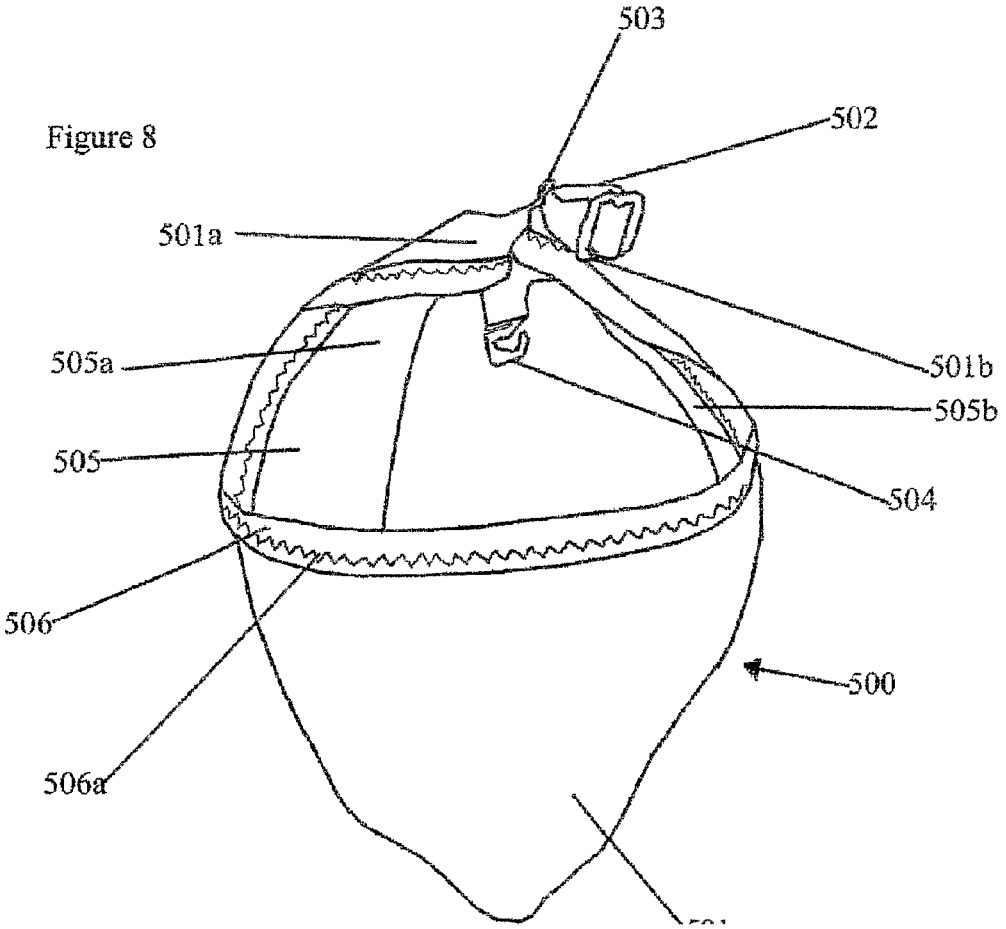
Figure 8A:
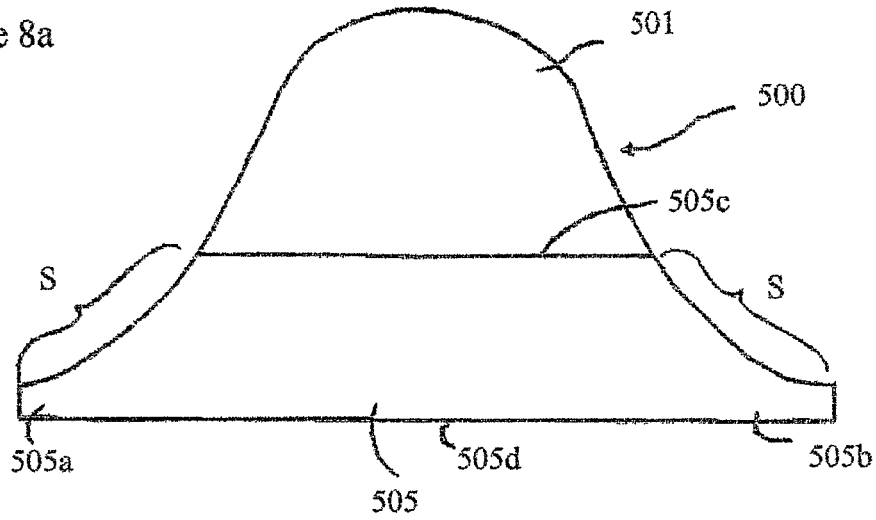
Figure 8B:
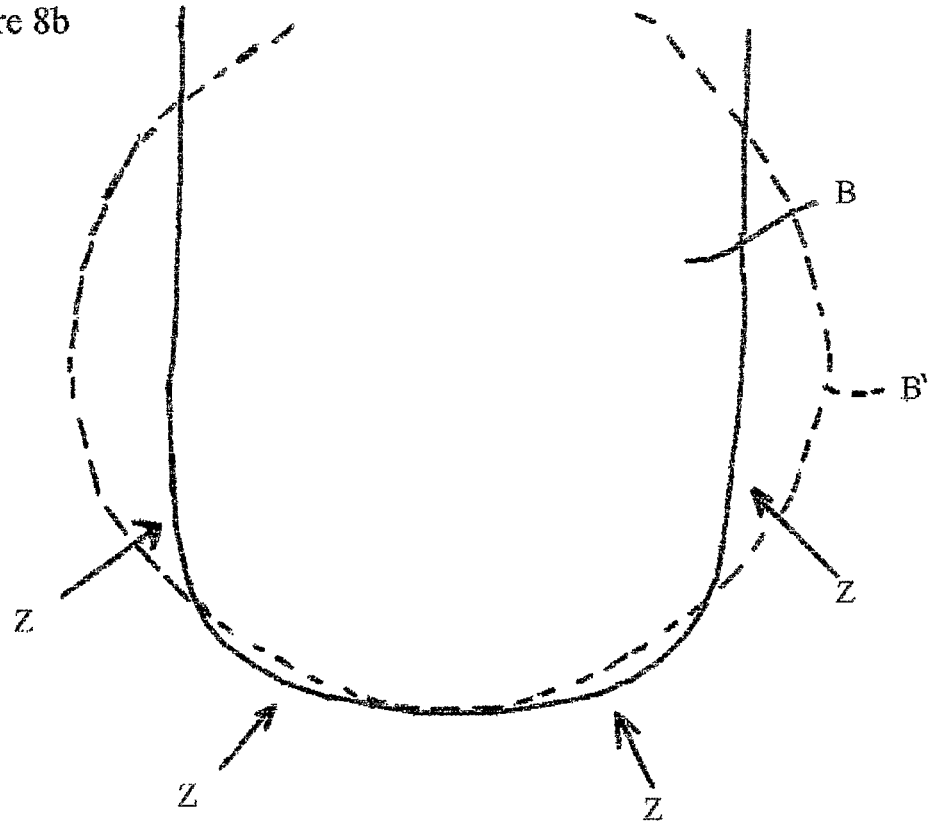

Accordingly, further embodiments of breast support apparatus in accordance with the present invention, will now be described, by way of example only, with reference to the further accompanying drawings, in which:

FIG. 7 shows a flattened, inside-out, side view of a second embodiment of breast support apparatus in accordance with the present invention;

FIG. 8 shows an outside, front perspective view of the breast support apparatus shown in FIG. 1 shaped ready to fit onto a breast;

FIG. 8*a* shows diagrammatically the format of the support apparatus of FIGS. 7 and 8 before the ends thereof are connected together to form a closed loop;

FIG. 8*b* shows diagrammatically how a breast can be lifted and reshaped by the breast apparatus in FIGS. 7, 8, and 8*a;*

Figure 9:
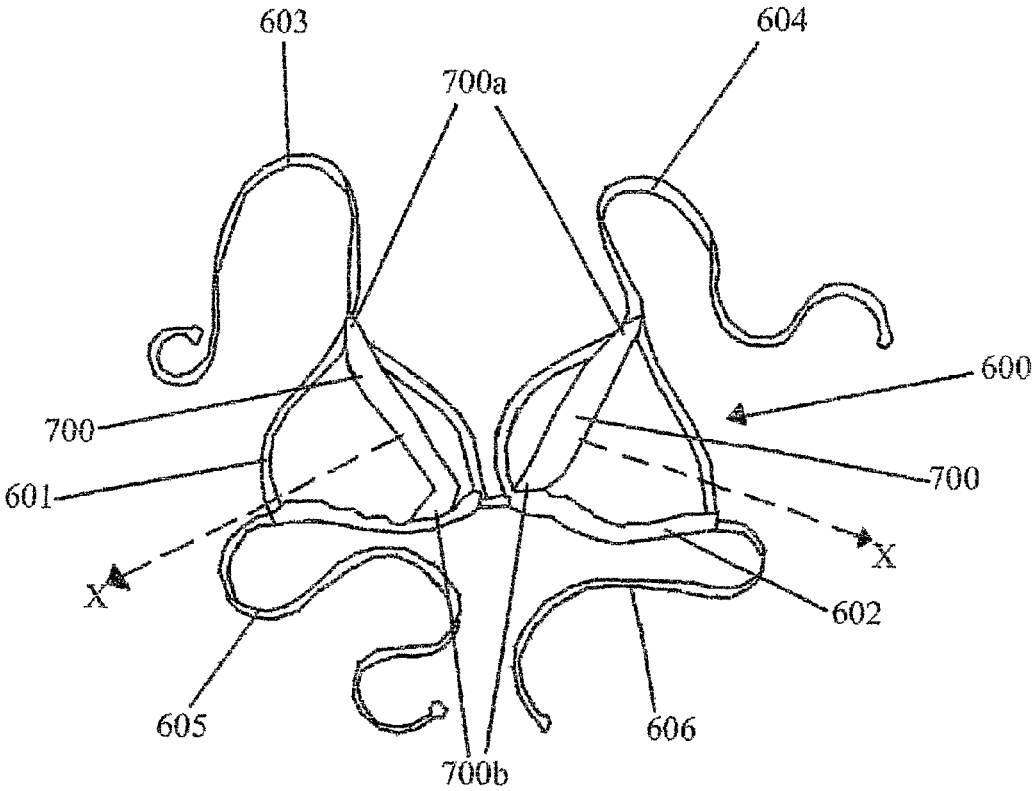
Figure 10:
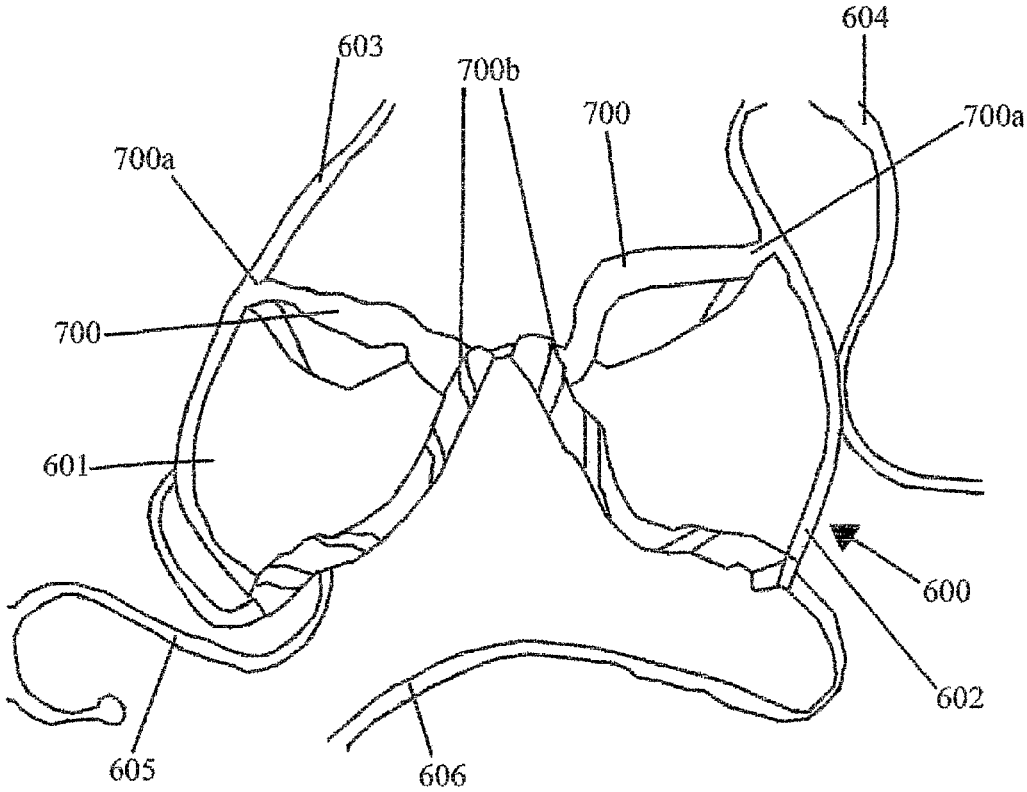
Figure 11:
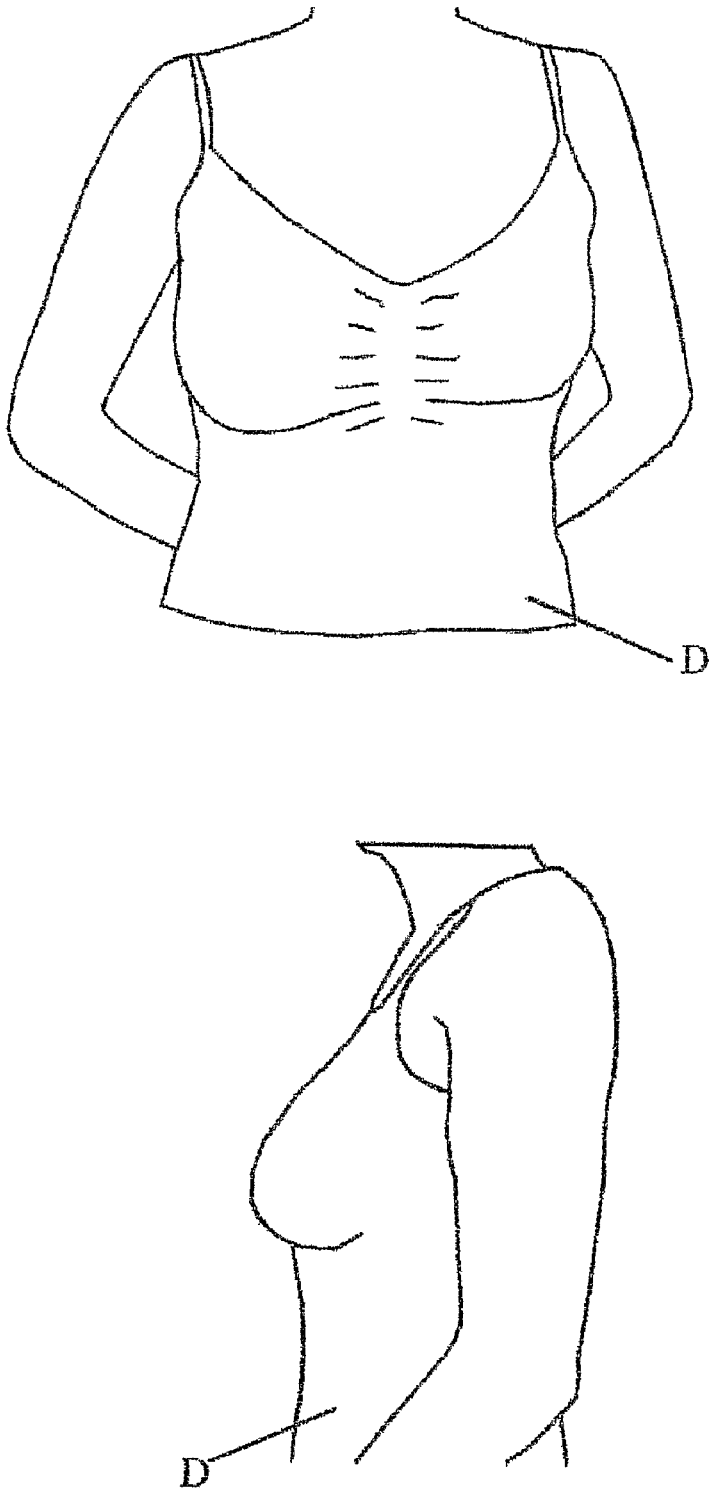

FIG. 9 shows an inside view of a bikini top which has been laid flat and which includes a third embodiment of breast support apparatus in accordance with the present invention in each bikini cup;

FIG. 10 shows an enlarged view of the bikini with the cups of the bikini moved so that each breast support apparatus has been pulled to one side of the associated bikini cup, and FIG. 11 shows front and side views of a girl wearing breast support apparatus in accordance with FIGS. 7 and 8 on her left breast only.

Referring to FIGS. 7, 8, 8*a* and 11 of the drawings a breast support apparatus 500 for use with any garment, for example the dress D shown in FIG. 11, includes a sling or wrap of material 501. The sling or wrap of material 501 is elasticated or 'stretchable' and non-slip, for example, being of cotton/polyester or being of any materials as described in relation to the breast apparatus 1 shown in FIG. 1. The sling or wrap of material 501 has been shaped as shown with the ends 501*a*, 501*b* being narrowed to the width of elasticated, connecting strap 502, said ends 501*a*, 501*b* being joined to the strap and to one another, for example, by appropriate stitching. The ends 501*a*, 501*b* of the strap are passed through an opening in metal connecting buckle 503 of the connecting strap 502. The connecting strap 502 may be used to connect or hook the breast apparatus 501 to an appropriate location on an outer garment (for example, to dress D by means of open end buckle 504, if desired).

Even so, it has been found that the breast support apparatus 500 is so advantageous and supportive that, in most cases, there will be no need to actually attach the breast support apparatus 500 to any supporting garment at all.

As will be evident from FIG. 7, the breast support apparatus 500 includes a strip of silicone or other grip material 505 (possibly adhesive tape) which, in use, will be arranged to support the breast from underneath in the area of the breast that adjoins the body. Once again, the ends 505*a* and 505*b* of the silicone strip 505 are curved and narrowed in the same way as the ends 501*a*, 501*b* of the sling material 501 (see FIG. 8*a*). The silicone 505 or other grip material may be sprayed onto the sling material 501.

The top rim of the breast support apparatus 500 has been edged with a material strip 506, by stitching 506*a*; a further line or seam of stitching 507 (see FIG. 7) runs from the central front part 508 of the apparatus 500 to the inner edge 505*c* of the stick on strip. The seam helps create the shape of the apparatus 500 in this embodiment.

In tests using the breast support apparatus 500, it has been found that said apparatus will adhere extremely successfully to the breast, through use of the silicone strip 505 and re-shape the breast, more particularly, due to the reduction in width of the silicone strip 505 and sling 501 towards the ends by tapering or curving gradually along section s of the sling (which, in use, will be on an upper part of the breast). Thus, the whole breast is very satisfactorily supported, shaped and enhanced and more rounded in appearance.

In fact, the breast support apparatus 500 acts to reshape or redistribute the mass of the breasts (more particularly where the breast has already lost a lot of its original shape and support and may sag) to provide a much more flattering appearance.

The silicone strip 505 helps to prevent the apparatus 500 moving around relative to the breast and helps retain the breast in its new shape.

It is to be noted (see FIG. 8*a*—connecting strap 502 omitted for clarity) that the ends 501*a*, 501*b* of the sling 501 and the ends 505*a*, 505*b* of the silicone strip 505 are only narrowed from the inner edge (leaving a straight outer edge 505*d*) that may be wrapped around into a circular shape on the breast unlike the shape of the ends on the breast support apparatus shown in FIG. 1 of the drawings, where each end of the apparatus 1 is shaped inwardly by oppositely curved side edges 1*a*, 1*b*: 1*c*, 1*d*.

FIG. 8*b* shows how a breast B can be rounded and reshaped to the format B' shown in dashed lines by forces acting generally in direction of the arrows Z. In practice, the breast B' may be considerably higher than shown in FIG. 8*b*.

FIG. 11 shows the remarkable results that can be obtained utilising the breast apparatus 500.

It is very important to realise, advantageously, that the format of breast apparatus 500 can be used successfully with any size of breast (particularly large breasts) to lift and support and re-shape same (by compressive forces) whereas, e.g. 'stick-on' or 'roll-on' breast cups can really only be utilised up to a C-cup. Thus, the breast support apparatus, in accordance with embodiments of the present invention can be thought of as performing more than just a support function but rather as a breast mass redistribution and re-shaping or firming/compressing apparatus.

FIG. 11 shows the application of the breast support apparatus to the left breast only as viewed underneath a dress D. Immediately, it can be seen how the breast support apparatus 500 can lift and reshape the breast compared to the right breast which is unsupported underneath the dress D. It is to be noted in this instance, that the left breast is very much higher than the right breast. It is to be appreciated in FIG. 11 that the breast apparatus 500 has not been attached to the dress D itself, it has simply been wrapped around and fixed onto the breast in a supporting, compressing and reshaping manner.

The Applicant believes that fabric of the breast support apparatus 500 onto which the silicone 505 is added should, advantageously, have good memory shape properties so that when flexed, the breast apparatus returns to original shape in order to seemingly maximise the shape and support of the garment and to increase the life of the apparatus i.e. the number of occasions the apparatus can be used.

Advantageously, any fabric extending across the nipples should, preferably have a much greater stretchable capacity in a horizontal direction, in use, than in a vertical direction to yield better re-shaping qualities; an accentuated or pointed appearance to the breast might otherwise result.

The width of the silicone strip 505 (or other elasticated strip) is, generally, dependent upon the size of the breast to be supported and will have a smaller width for a smaller breast. Importantly, for best support/shaping, it is believed that the upper portion of the breast needs less force acting thereon than the lower part, so that the strip 505 is, preferably, narrowed towards the ends (which are located, in use, towards the upper part of the breast) to provide less elastic force on the upper part of the breast than the lower part. Alternatively, or additionally, the part of the strip 505 (or other elasticated strip) located towards the upper portion of the breast may be of a material having a lower elasticity than the portion of the strip supporting the lower portion of the breast, thereby, similarly providing less elastic force on the upper portion of the breast.

Furthermore, preferably, any nipple covering should be shaped to avoid seams being visible underneath a garment.

Preferably, the breast support apparatus is adjustable (to one cup size) e.g. using hooks and eyes to allow fastening.

Preferably, the encircling design of apparatus 500 should be openable/expansible (rather than rigid) to allow the apparatus to be applied easily onto the breast.

FIGS. 9 and 10 show views of a bikini top 600 including a loosely located breast support apparatus 700 attached to each generally triangular bra cup 601, 602.

As should be evident from FIGS. 9 and 10 each breast support apparatus 700 consists of a strip of fabric of similar shape to the breast apparatus 1 shown in FIG. 1 of the drawings without the press stud portions 3*a*, 3*b*. The ends only of the breast support apparatus 700 are attached (for example by stitching or press studs if desired) as shown. The upper end 700*a* of each bra apparatus 700 is attached to the inner, top, apex edge of the respective bikini cup, 601, 602 and the lower end 700*b* of each apparatus 700 is attached close to the inner apex or corner of each cup 601, 602 along the bottom edge thereof. The sides of the apparatus 700 remain free (or loose) of any attachment or stitching to the associated bikini cup.

In use of the bikini top 600 and breast support apparatus 700, each apparatus 700 will be moved (displaced or deformed) or stretched generally in the direction of arrow X from the centre to move the apparatus 700 around the outside periphery of the breast to partially encircle or wrap around all of the underside of each breast from near the central cleavage around the outside of each breast to a point uppermost on the breast which would usually be vertically above the nipple.

In this way, each breast apparatus 700 supports and reshapes the breast giving lift and pushing the breasts together for mutual support at the cleavage.

In practice, whilst the attachment of each breast apparatus 700 may appear to be a relatively simple support means it is surprising just how effective such support is merely by the employment of the breast apparatus 700 in the form of a (stretchable) partial wrap or partial sling on each breast.

The bikini top has straps 603 and 604 leading from the upper apex of each cup before attaching them together around the neck of the user. The outside apex of each cup 602 has an associated strap 605, 606 and these straps can be tied together around the back of the user.

Therefore, still further according to the present invention there is provided a garment, such as a bikini top, including two breast cups, each breast cup including a breast support apparatus, preferably, diagonally mounted or inclined on the associated cup, preferably extending from adjacent an upper apex of the associated cup and extending downwardly in use to a lower location on each cup.

Further according to the present invention there is provided a breast support apparatus for the garment as described in the immediately preceding paragraph.

Each breast apparatus may comprise a strip of material that acts in use to support the breast underneath and from an outside edge to partially encircle the breast, pulling the breast upwardly and inwardly towards the cleavage of the breasts.

Preferably, the strip or piece of material is attached (permanently or releasably) at one end at or adjacent an upper part of the cup, in use, and attached at an opposite end at or adjacent a lower part of the associated cup. The strip of material may be displaceable along its length relative to the associated cup.

Japanese patent Specification No. JP 2002309404 shows a brassiere having a pair of curved branched straps integrated into the material of the bra at the side of the cups. The straps are integrated and sewn into position along their length into the material (already in a curved shape) of the brassiere and are not loosely located so as to be displaceable/deformable along their length and pulled to one side of the associated cup (to partially encircle the breast) as a breast is introduced into a bra cup in order to support the breast.

Still further according to the present invention there is provided breast support apparatus adapted in use to hold and compress at least one breast (preferably-completely-encircling the breast) in order to redistribute the mass of the breast uplifting and reshaping the breast and raising the level of the nipple. The apparatus may be in the form of a (stretchable) compression ring or tube.

The invention claimed is:

1. A bikini top or brassiere comprising:

two breast cups and wherein each breast cup has:

at least one strip of stretchable material, comprising a loosely located inner strip, which is attached at one end to an upper part of said breast cup and attached at a lower end to said breast cup wherein said strip is adjustable in length and is adapted to support at least one breast, wherein said strip is diagonally mounted on said breast cup to extend inside said breast cup from an upper attachment end to a lower cleavage attachment end and configured to pull the breast, in use, upwardly and inwardly towards the cleavage of the breasts.

2. A garment, comprising:

two breast cups, a breast support apparatus coupled to each cup of said two breast cups, and being adjustable, relative to an associated breast cup, and comprising a piece of stretchable material comprising a loosely located, inner strip wherein in use, said strip is attached at one end at or adjacent an upper part of the breast cup, and attached at an opposite end at or adjacent a lower part of the associated breast cup, the arrangement being such that the piece of stretchable material is adjustable along its length relative to the associated breast cup as a breast is introduced into the breast cup, to support the breast underneath and from an outside edge to partially encircle the breast, pulling the breast, upwardly and inwardly towards the cleavage of the breasts, the piece of stretchable material, being mounted on the associated breast cup wherein said strip is diagonally mounted on said breast cup to extend inside said breast cup from said upper attachment end to said lower attachment end.

3. The garment as claimed in claim 2 in which said piece of stretchable material is formed as a sling and is shaped inwardly from a direction at a center of a breast area at its ends to allow the sling to sit neatly on the breast while holding the breast with the breast supported from said outside edge.

4. The garment as claimed in claim 3 in which said sling has ends that are shaped inwardly to form curved ends.

5. The garment as claimed in claim 4 in which said curved ends comprise oppositely curved side edges.

6. The garment as claimed claim 2 in which the piece of stretchable material is diagonally mounted or inclined on the associated breast cup towards a cleavage area of the wearer.

7. The garment as claimed in claim 2 in which the piece of stretchable material extends from at or adjacent to an upper, apex of the associated breast cup and extends downwardly, in use, to a lower location on said cup.

8. The garment as claimed in claim 7 in which the lower location is at or adjacent to an apex or corner of the associated breast cup along a bottom edge of the associated breast cup.

* * * * *